United States Patent [19]

Thebaud

[11] 4,278,288

[45] Jul. 14, 1981

[54] CHAIR PROVIDED WITH INTERLACING AND INTERMESHING SEAT AND BACK PORTIONS SUPPORTED BY ARCUATE SUPPORT MEMBERS

[76] Inventor: Sacha Thebaud, P.O. Box 446, Port-au-Prince, Haiti

[21] Appl. No.: 52,186

[22] Filed: Jun. 26, 1979

[51] Int. Cl.[3] ..... A47C 5/00

[52] U.S. Cl. ..... 217/118; 297/445; 297/258; 5/191

[58] Field of Search ..... 297/18, 16, 258, 32, 297/56, 445, 131, 132, 118; 5/129, 191

[56] References Cited

U.S. PATENT DOCUMENTS

| | | | |
|---|---|---|---|
| 674,664 | 5/1901 | Bergsten | 5/129 X |
| 728,943 | 5/1903 | Lepard | 297/132 |
| 1,342,650 | 6/1920 | Schlegel | 297/56 X |
| 1,716,176 | 6/1929 | Keresztfalvy | 5/191 |
| 2,414,978 | 1/1947 | Richardson | 5/191 X |
| 3,269,771 | 8/1966 | Erdos | 297/132 |

FOREIGN PATENT DOCUMENTS

| | | | |
|---|---|---|---|
| 363222 | 11/1922 | Fed. Rep. of Germany | 297/132 |
| 621843 | 2/1927 | France | 297/56 X |

*Primary Examiner*—Francis K. Zugel
*Attorney, Agent, or Firm*—Hauke and Patalidis

[57] ABSTRACT

A structure for a chair comprising a pair of substantially identical modular units each consisting of at least a pair of parallel bowed arcuate ground support members each shaped substantially as an arc of a circle and maintained in spaced relationship parallel to each other at their end by a cross-bar member to which are attached spaced apart stretched elongated flat bands or straps of plastic material, leather or fabric disposed substantially along the chord of the circular arc formed by the support members. Two basic modular units are longitudinally intermeshed together and angularly disposed to form a chair having a back supporting area and a seat supporting area defined by the exposed chordal straps of each modular unit. The angular position of the back supporting area relative to the seat supporting area may be pre-established or adjustable depending on whether the bowed arcuate support members of one modular unit are fixedly interconnected or removably and adjustably interconnected to the bowed arcuate support member of the other modular unit. In structures wherein the bowed arcuate support members are pivotally interconnected, in addition to the seat area being angularly adjustable relative to the seat area, the two areas are adjustable relative to each other such as to form a single substantially co-planar body supporting surface in the form of a hammock, and further facilitating transportation of the chair. The relative longitudinal position of the two modular units permits to obtain at will a stable chair or a rocking chair. The manner in which the diverse elements are assembled together may be such that all the elements may be disassembled and reassembled to facilitate transportation and packaging.

56 Claims, 34 Drawing Figures

82
22
12
86
84
84
84
88
30
86
84
22
12
22

90
32
90
22
22
30
19
19
20
20
88
82

88
30
90
90
90
90
22

90
88
32
90
84
80
80
84
22

90
88
90
32
22

32
28
22
26
30
100
99
102
104

28
12
26
99
32
14
30
100
106
104
102
106
99
112

30
26
12
100
99
32
14
28
104
106
102
99
112
106

100
10'
24
20
99
12
100
26
22
28
22
20
99
102
14
30
100
100
20
20
104
102
106
111
108
110

100
30
50
20
10''
100
12
26
22
28
22
20
14
32
108
110
102
20
102
28
112
106
104

FIG. 27
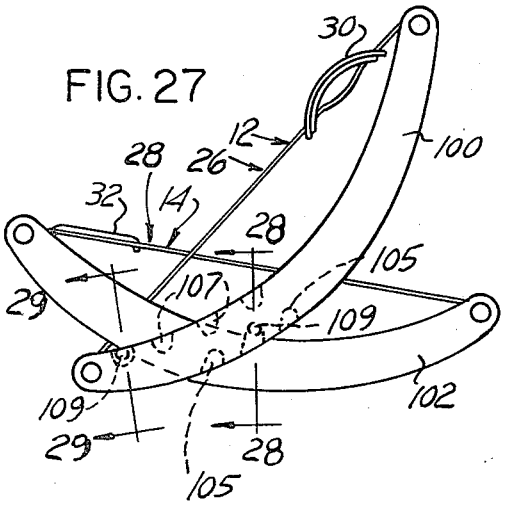
FIG. 28
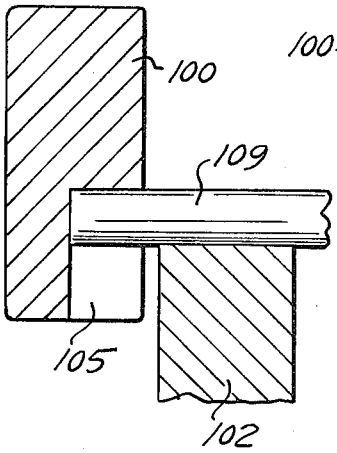
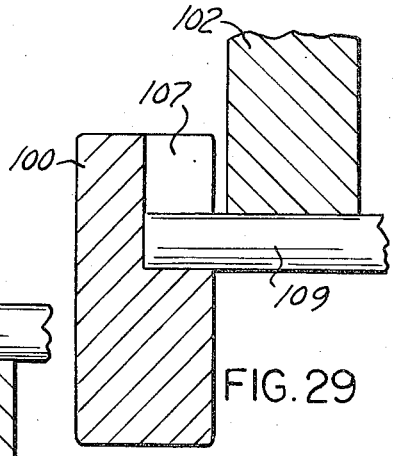
FIG. 29
FIG. 30
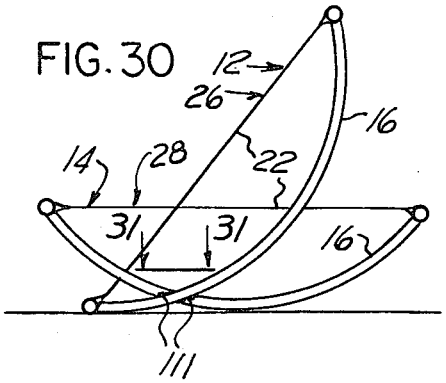
FIG. 32
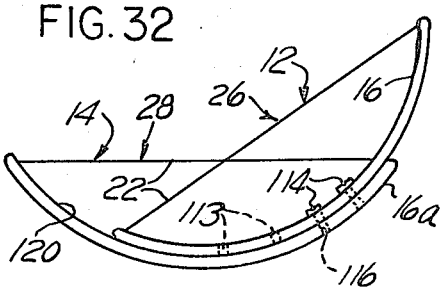
FIG. 31
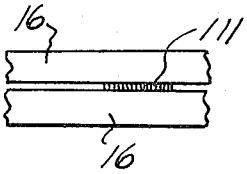
FIG. 33
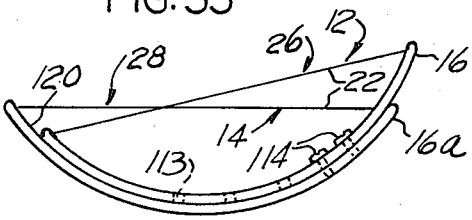
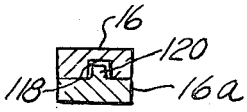
FIG. 34

CHAIR PROVIDED WITH INTERLACING AND INTERMESHING SEAT AND BACK PORTIONS SUPPORTED BY ARCUATE SUPPORT MEMBERS

BACKGROUND OF THE INVENTION

The present invention relates to a structure for a chair, hammock, and the like, which is relatively simple to manufacture at low cost, which does not require skilled labor, can be compactly packaged for transportation, is easily erected and presents an aesthetic agreeable appearance.

In applicant's prior application, Ser. No. 889,936, filed Mar. 27, 1978 there is disclosed a system of furniture, such as tables and chairs, taking the form of a plurality of profiled contour rigid slats disposed in at least two separate groups criss-crossing or interlacing each other, the slats in each group being interconnected with each other at their end, a portion of the slats proximate an end in each group forming the seat area of a chair, for example, and the other ends of the slats of the same group forming a ground support for the chair, while the area formed by the slats proximate to an end of the other group define the back of the chair, with the ends of the slats of the second group defining another ground support member of the chair.

The present invention also utilizes seat and back load supporting areas which are formed by interlacing members, but such members are made, in the present invention, of bands, or straps of pliant material stretched as chordal members between spaced apart substantially parallel bow-shaped ground engaging arcuate support members, two separate groups of arcuate members being interconnected fixedly with the result that the plane of the chordal straps associated with a group of arcuate support members is at an angle to the plane of the chordal straps associated with the other group of arcuate support members, or being interconnected alternatively in an adjustable manner so as to permit different inclinations of a group of chordal straps relative to the other group.

SUMMARY

The principal object of the present invention is to provide a new system for furniture, principally chairs and the like, having supple conforming well-ventilated back supporting and seat supporting portions, which can be manufactured at low cost with a small number of different elements, which are easily assembled in diverse finite or adjustable shapes, which are pleasant in appearance, which can be made of any convenient available material, which, in spite of their light weight, can support a considerable load, and which can be erected in the form of a stable chair, or in the form of a rocking chair, in the form of a stable hammock, or in the form of a rocking hammock.

These and other objects and advantages of the present invention will become apparent to those skilled in the art when the following description of examples of the best mode contemplated for practicing the invention is read in conjunction with the accompanying drawing wherein:

BRIEF DESCRIPTION OF THE DRAWINGS

FIGS. 27–29 schematically illustrate modifications of the chair of FIG. 23; and FIGS. 30–34 illustrate further modifications of a modular chair structure according to the present invention.

DETAILED DESCRIPTION OF THE PREFERRED EMBODIMENTS

Figure 1:
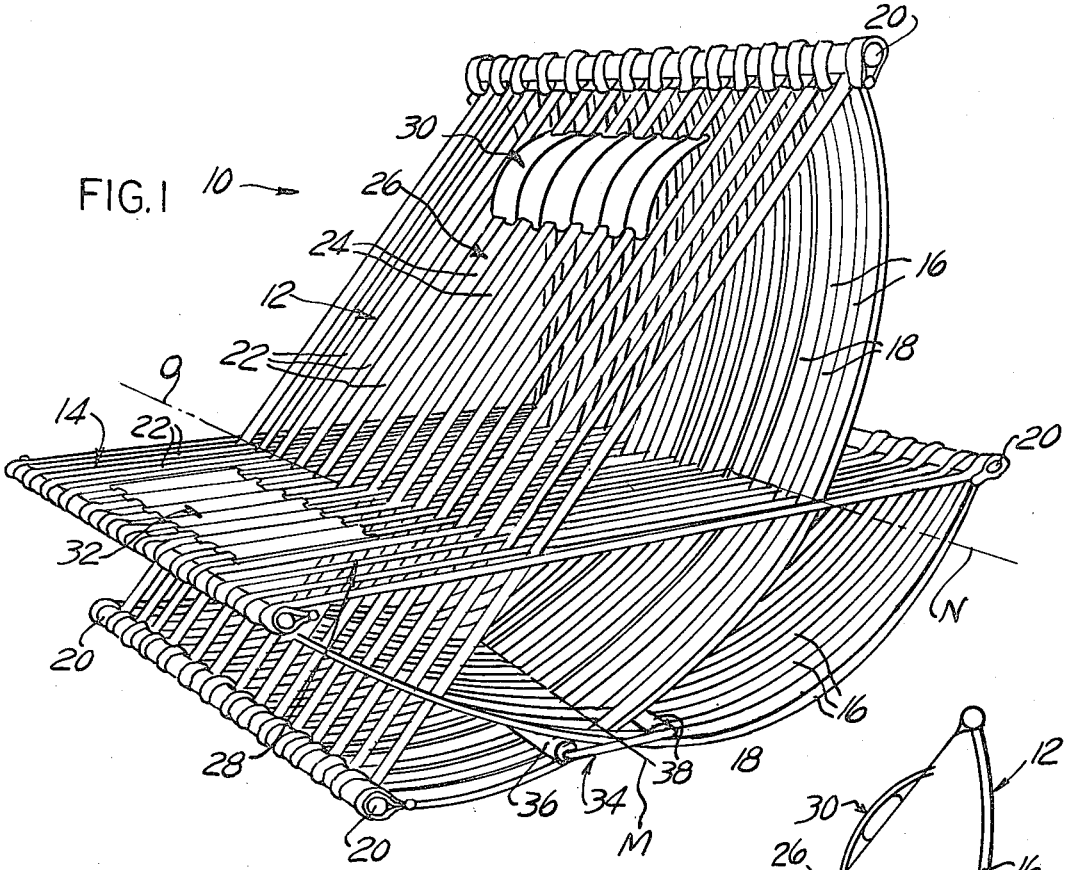
FIG. 1 is a perspective view of an example of a modular chair structure according to the present invention.

Referring now to the drawing and more particularly to FIG. 1, a chair 10 according to the present invention comprises a pair of substantially identical modular units 12 and 14, each made of a frame member comprising a plurality of bow-shaped rigid elongated arcuate struts or ground support members 16 disposed parallel to each other and regularly spaced apart, as shown at 18, by being attached at each end to a connecting cross-bar member 20. A body or load support surface is defined by a plurality of separate bands or straps 22 of supple pliable material, all of equal width which are stretched such as to extend along the chord of the bow-shaped arcuate members 16, the ends of the bands or straps 22 being attached to the cross-bar member 20 fastened at the end of each group of substantially parallel bowed arcuate members 16, each in a space between consecutive bow-like arcuate members 16. The plurality of stretched chordal straps 22 in each group are thus substantially co-planar, parallel to each other, and spaced apart as shown at 24. The spaces 24 are of uniform width which is equal to or slightly larger than, the width of each chordal strap. A complete chair is formed by introducing the modular unit 12 of one group of bowed arcuate rigid support members 16 with their corresponding chordal stretched straps 22 into the modular unit 14 consisting of a separate group of bowed arcuate rigid support members 16 provided with their corresponding chordal stretched straps 22, such that the arcuate support members 16 of one group are disposed in the space 18 between the arcuate support members 16 of the other group and project through the spaces 24 between the chordal straps 22 of the other group, generally in the relative arrangement illustrated at FIG. 1. It can be seen that the bowed arcuate support members 16 of one modular unit, such as the modular unit 12 criss-cross or interlace along a first transverse imaginary line M with the bowed arcuate support members 16 and along a second transverse imaginary line N with the chordal straps 22 of the modular unit 14, that the modular unit 12 and 14 are disposed intermeshing one relative to the other such that the stretched chordal straps 22 of the modular unit 14 are substantially along a horizontal plane, while the stretched chordal straps 22 of the modular unit 12 are generally disposed in a plane at an angle to that substantially horizontal plane. The stretched chordal straps 22 of the modular unit 12 interlace with the chordal straps of the modular unit along a third transverse imaginary line O. A chair 10 is thus formed having a back support portion or area 26 and a seat support portion or area 28. For added comfort of a person seating on the chair 10, the back support area 26 may be provided with a head rest pad or cushion 30 and the seat portion 28 may be provided with a seat pad or cushion 32, examples of structure whereof are hereinafter explained in further detail.

Figure 2:
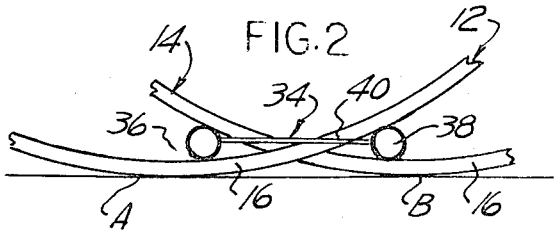
FIG. 2 is a partial schematic side view thereof.

As shown at FIGS. 1 and 2, the two modular units 12 and 14 are held in their relative angular position by means of a wedge member 34 comprising a pair of substantially parallel laterally extending rods or tubular members 36 and 38 prevented from spreading apart by being interconnected at each end by one of a pair of straps 40 of predetermined length, or preferably of adjustable length. The rod 36 is wedged between the tops of the arcuate support members 16 of the modular unit 12 and the bottoms of the arcuate support members 16 of the modular unit 14, while the rod 38 is wedged between the tops of the arcuate support members 16 of the modular unit 14 and the bottoms of the arcuate support members 16 of the modular unit 12. The distance separating the rods 36 and 38, depending from the length of the straps 40, determines the distance or span between the points A and B of tangential contact with the ground of respectively the group of arcuate support members 16 of the modular unit 12 and the group of arcuate support members 16 of the modular unit 14.

Figure 3:
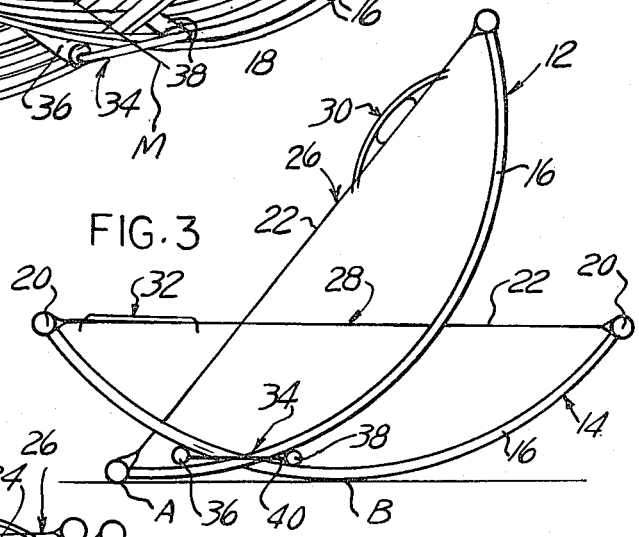
FIGS. 3–6 are schematic side elevational views thereof, illustrating a variety of seat and back angular adjustments thereof.
Figure 5:
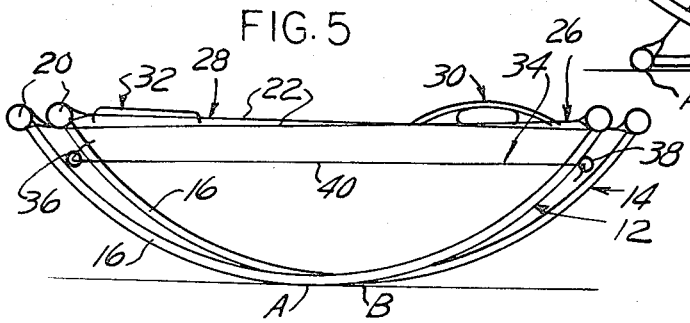
Figure 4:
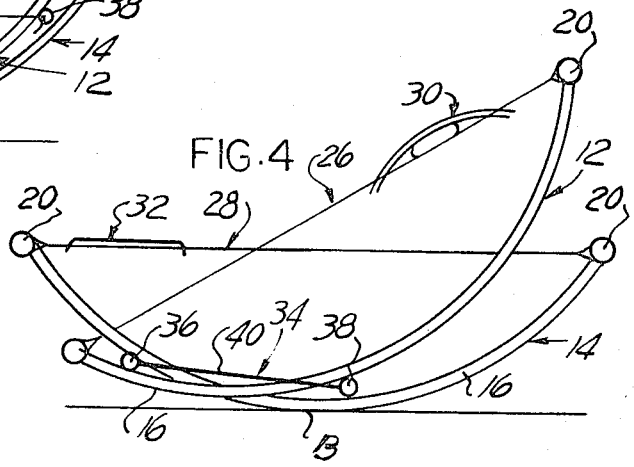
Figure 6:
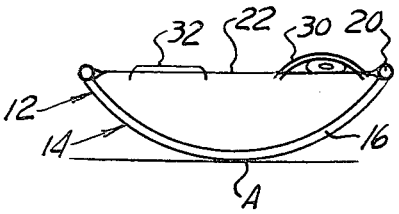

The length of the straps 40 also determines the angle of the back portion 26 relative to the seat portion 28 of the chair 10, as schematically illustrated at FIGS. 3 and 4. By using long straps 40 to interconnect the two parallel wedging rods 36 and 38, the chair 10 becomes literally a rocking chair, FIG. 4, having, for all practical purposes, only one single rolling point of contact with the ground at a tangent B of the arc of circle of each bowed support member 16 with the ground, the line of points A being normally off the ground. At the extreme position of the wedging rods 36 and 38, and as illustrated at FIG. 5, the two modular units 12 and 14 are almost laterally intermeshed, and they form a rocking hammock having however two close but separate lines of points A and B of contact with the ground for each group of bowed support members 16, thus creating a tendency for the rocking hammock to balance itself in a finite position, in the event that the center of gravity of the load supported by the chordal straps 22 falls between the lines of point A and B. It may be found more convenient to remove entirely the wedging assembly 34 and to freely dispose the two modular units 12 and 14 intermeshing with each other to form a single hammock, as shown at FIG. 6, with a single longitudinally displaceable line of tangential points A of contact with the ground of each bowed support member 16. Occasionally, two hammocks may be formed, by simply utilizing each modular unit 12 and 14 separately.

Figure 7:
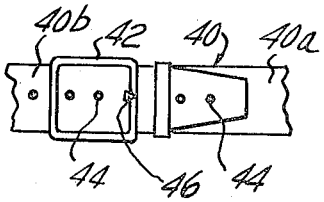

Any appropriate structure capable of providing an adjustable length for the connecting straps 40 of the wedging unit 34 may conveniently be used such as, for example, the arrangement illustrated at FIG. 7 consisting of forming the straps 40 of two separate lengths **40*a* and 40*b* of material such as canvas or leather, providing the end of the strap length 40*a* with a buckle 42 and the strap length 40*b* with holes 44 removably engageable by the tongue 46 of the buckle 42**.

Figure 8:
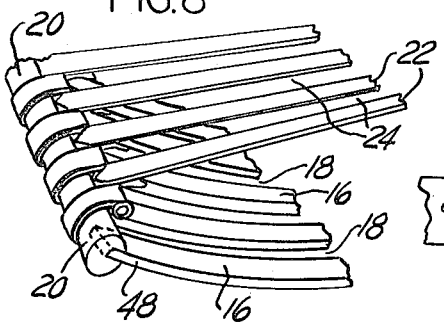
FIGS. 7–9 are details of construction thereof.

The bowed arcuate members 16 are substantially rigid and made of shaped strips of wood, laminated wood, aluminum, steel, or any other convenient material. The connecting cross-bar members 20 are also made of any convenient material such as wood rods, steel rods, aluminum rods and the like. The bands or straps 22 are made of thin bands of pliable flexible material such as plastic, canvas, leather and the like. It will be readily apparent that any amount of bow and spring pre-load may be given to the bowed arcuate member 16 when made of rigid but essentially resiliently bendable material, resulting in diverse amounts of tension being applied to the straps 22 according to their overall length relative to the length and amount of spring preload bow imposed upon the arcuate ground support members 16. As shown in detail at FIG. 8, the cross-bar members 20 are preferably provided with regularly spaced parallel peripheral slots 48 in each of which is engaged an end of each bowed arcuate member 16. Frictional engagement of the arcuate member ends in the slots 48 may be sufficient, especially when the chordal straps 22 attached to the cross-bar members 20 are stretched between the two cross-bar members of each modular unit under the tension resulting from resiliently prestressing the bowed arcuate members 16. The ends of the arcuate members 16 may otherwise be press-fitted, cemented, brazed or welded in the slots 48 of the cross-bar members 20 according to what materials are used and to whether or not it is desired to provide permanent fastening of the assemblies.

Figure 9:
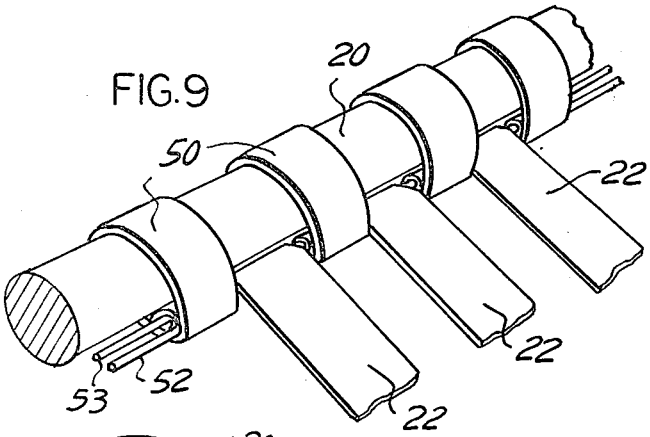
Figure 10:
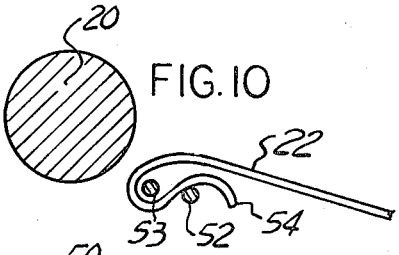
FIGS. 10–12 are schematic illustrations of an example of structure for attaching the load carrying bands or straps thereof to a support member.
Figure 11:
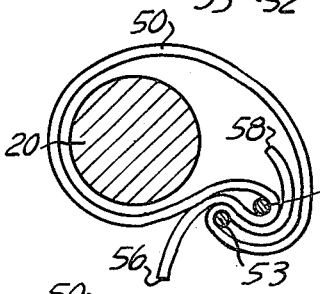
Figure 12:
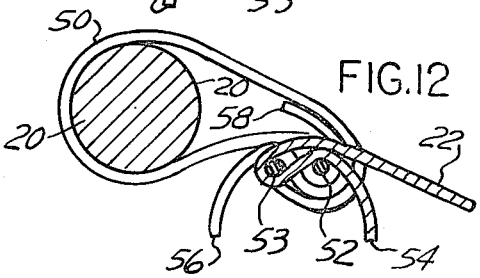

FIG. 9 illustrates generally, and FIGS. 10–12 illustrate in detail, the arrangement for attaching the elongated band or straps 22 of supple pliable material to a cross-bar member 20 by means of short lengths or straps 50 of pliable material, which may be the same as the material of the bands or straps 22, and of a pair of cooperating slender rods 52 and 53. The short straps 50 are substantially in the form of loops, each one disposed between two consecutive chordal straps 22 and acting as a spacer separating the straps with the space 24 therebetween at the same time as acting as a means for anchoring the chordal strap ends to the cross-bar member 20. As shown in detail at FIG. 10, the end 54 of each chordal strap 22 is passed around the rod 53 and above the rod 52. As illustrated schematically at FIG. 11, one end 56 of the short support strap 50 is looped around the rod 52, and the other end 58 of the short strap 50 is looped around the rod 53. The final arrangement is as schematically shown at FIG. 12 which illustrates the chordal band or strap 12 in cross-section in the foreground, and the short mounting strap 50 adjacent thereto in the background. It is immediately apparent from FIG. 12 that a pull exerted on the end 54 of the chordal strap 12 tensions the chordal strap and frictionally holds it in an appropriate position due to the lacing around the rod 53 and above the rod 52, and further by the frictional and compressive engagement of the engaged surfaces of the strap above the rod 52. A pull exerted on the end 56 of the short mounting strap 50 pulls the rods 52 and 53 toward each other and toward the cross-bar member 20, increasing the tension on the chordal strap 12 and immobilizing the diverse elements in position. In this manner, a simple, effective and adjustable attachment of the chordal straps 12 to the cross-bar members 20 is achieved.

Figure 13:
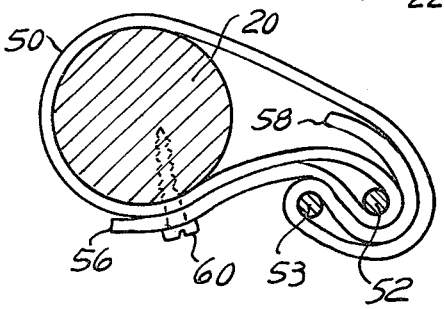
FIGS. 13–16 are schematic illustrations of modifications of the structure of FIGS. 10–12.

If it is desired to provide a more secure anchoring of the short mounting straps 50, one end thereof, such as the end 56 of the mounting strap, is permanently affixed to the cross-bar member 20 by means of a wooden or metal screw 60 according to what material is used for making the cross-bar member 50. The screw 60 passes through the superimposed thicknesses of the short mounting strap 50 proximate its end 56 and of the portion of the mounting strap surrounding the periphery of the cross-bar member 20. The other end of the short mounting strap 50 may be left free, as shown at FIG. 13, or it may also be attached by means of a screw to the cross-bar member 20. The chordal load-carrying straps 12 are attached to the rods 52 and 53 by lacing in the same manner as illustrated at FIGS. 10 and 12, and their tension may be adjusted in the same manner as previously explained.

Figure 14:
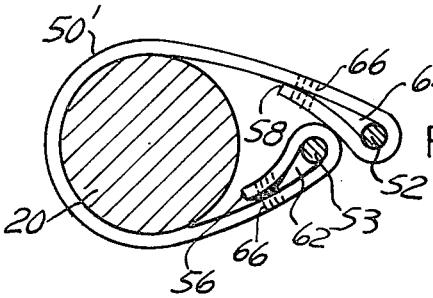
Figure 15:
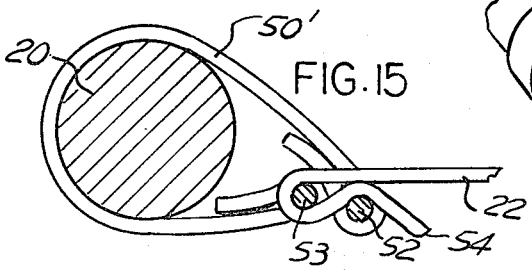

Alternatively, and as illustrated at FIGS. 14 and 15, modified short mounting straps 50' may be substituted for the previously described mounting straps. Each mounting strap 50' has both its ends 56 and 58 doubled over in the form of a loop 62 and 64, respectively, the portions of the strap proximate the ends 56 and 58 being respectively attached to the adjoining portion of the strap by stitching, as shown at 66, by staples, by cementing, or by any other convenient means. The rods 52 and 53 are passed respectively through the loop 64 and the loop 62, and the chordal load-supporting straps 12 are attached to the rods 52 and 53 in the same manner as precedingly explained by wrapping their end 54 around the rod 53, and passing the end 54 above the rod 52, such as to squeeze the area of the strap proximate the end 54 between the rod 52 and the lower surface of the chordal strap.

Figure 16:
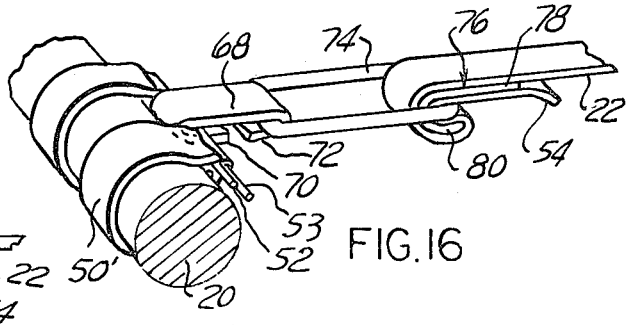
Figure 18:
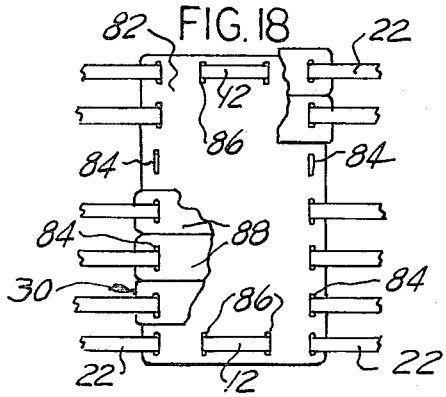
FIGS. 17–21 illustrate examples of structure for providing built-in cushions therefor.
Figure 17:
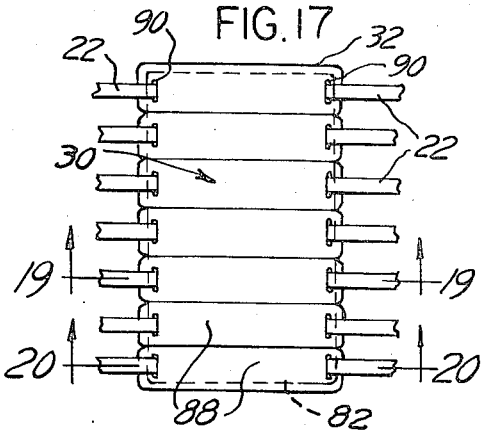

FIG. 16 illustrates in perspective a further arrangement for attaching the ends of the load-carrying chordal straps 12 to the cross-bar members 20 by means of the anchoring or mounting straps 50' of FIGS. 14 and 15 and of the rods 52 and 53 passed through the end loops of the mounting straps. A substantially C-shaped rigid clip 68 has a bent-over end 70 hooked over the rods 53 and 52, and a similarly bend-over end 72 hooked over a portion of a loop 74 made preferably of strong relatively large diameter elastomeric material such as rubber or the like. The load-carrying chordal straps 12 are adjustably attached to the loop or sandow 74 by means of a substantially J-shaped bracket insert 76 having a substantially straight body portion 78 and a bent-over end portion 80. The end 54 of each chordal strap 12 bracket insert 76, such that a portion of the chordal strap 12 proximate the end 54 thereof lines the surface of the bracket insert 76. By providing the surface of the J-shaped bracket insert 76 with a rough frictional surface, friction alone, is sufficient to hold the ends of the load-supporting chordal strap 12 in position as illustrated at FIG. 16 under the tension exerted by the elastomeric loop or sandow 74. Alternatively, appropriate means such as small metal screws may be used for attaching the lower strand of the chordal strap 12 to the lower surface of the straight portion 78 of the bracket insert 76, or an adhesive may be used. In this manner, an elastic attachment of the load-supporting chordal straps 12 to the cross-bar members 20 is achieved.

Figure 21:
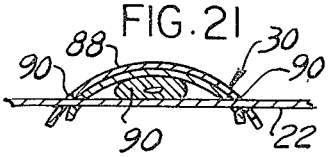
Figure 20:
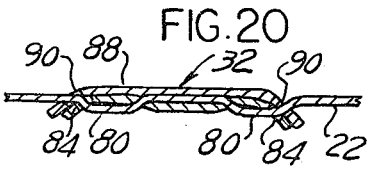
Figure 19:
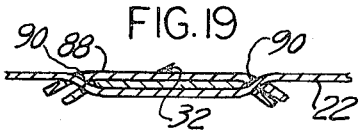

As shown at FIGS. 17–20, the seat pad or cushion 32, FIG. 1, is made of a subjacent sheet 82 of pliable material having a plurality of edge slits 84 through which are passed the stretched chordal straps 12, the lateral edge of the subjacent sheet 82 being preferably provided with an additional pair of slits 86 through which is further laced the corresponding chordal straps 12. A plurality of substantially rectangular elongated cushion strips 88 made of soft material are disposed on the top of the subjacent sheet 82, the chordal straps 12 being passed through appropriate slits 90 proximate each end of the rectangular strips 88. If so desired, the plurality of juxtaposed strips 88 may be replaced by a single sheet of soft material. The subjacent sheet 82 acts as a support for the strips 88 at the same time as functioning as a spacing means for the chordal strips 12 and as a retaining means preventing them from effectively separating away from each other at the surface area of the chair substantially supporting the weight of the body of a person sitting or lying on the chair. It is readily apparent that a padding may be disposed between the subjacent sheet 82 and the upper strips 88 to provide a soft cushioning effect or, in the alternative, an elongated pillow-like resilient cushion 91, FIG. 21, may be removably or permanently placed either between the subjacent sheet 82 and the strips 88 or below the subjacent sheet 82, as illustrated, between the lower surface thereof and the upper surface of the portion of the chordal strips 12 disposed therebelow, such as to form, for example, a headrest 30, FIGS. 1 and 21.

In order to provide a symmetrical appearance of the assembled chair 10 of FIG. 1, the modular unit 12 and 14 are slightly different in width, as illustrated, the modular unit 12 being slightly narrower than the modular unit 14, but only of a small amount which is the equivalent of the width of a single chordal strap 22, such that the modular unit 12 nests within the modular unit 14 in the manner illustrated. It will be appreciated that the two modular units 12 and 14 may be of the same width, in which case although they would nest within each other, one modular unit when intermeshed with the other is staggered relative to the other approximately of the width of one chordal strap 12 or of one bowed arcuate support member, each chordal strap 12 having substantially the same width as an arcuate support member 16.

Figure 22:
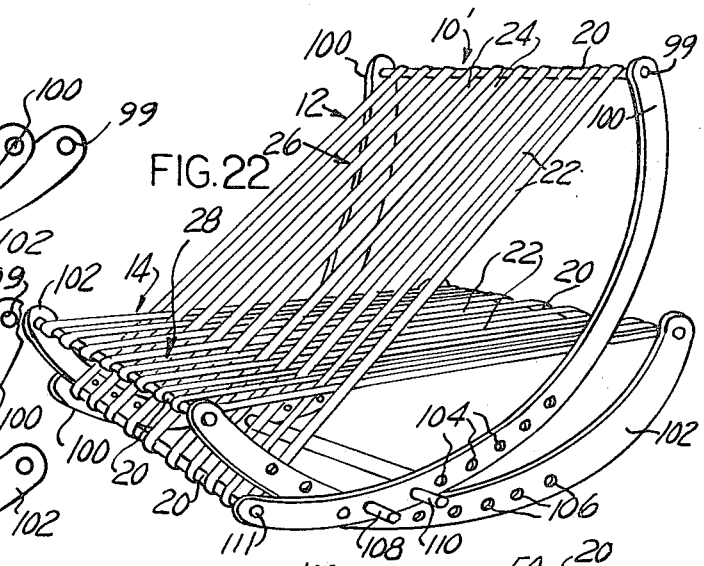
FIG. 22 is a perspective view of a modification of the modular chair structure of FIG. 1.
Figure 23:
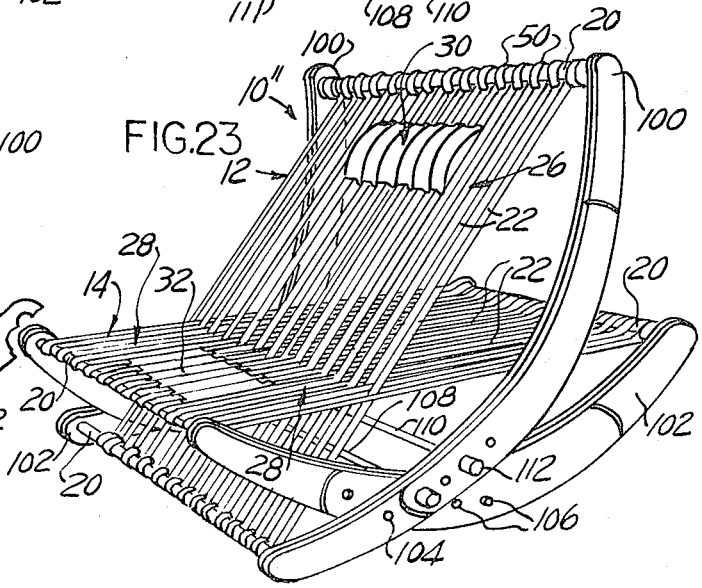
FIG. 23 is a perspective view of a further modification thereof.

The plurality of arcuate support members 16 disposed between the extreme lateral arcuate support members of each modular unit may be omitted, and the resulting structure is a chair 10' as illustrated at FIGS. 22 and 23 wherein the extreme lateral bowed arcuate support members have further been replaced by sturdier substantially rigid arcuate frame side members 100 in the modular unit 12, and for the extreme lateral arcuate support members of the modular unit 14 there has been substituted a pair of identical sturdy rigid arcuate frame side members 102. A cross-bar member 20 is mounted between each of the ends of the arcuate frame side members 100 and 102 respectively and, in the example of structure illustrated, the modular unit 12 has a width slightly larger than the width of the modular unit 14 such that the arcuate frame side members 102 nest within the span the arcuate frame side members 100, adjacent to the frame side members 100. The frame side members 100 are provided with a plurality of spaced transverse holes 104, and the arcuate frame side members 102 are provided with spaced transverse holes 106. A rod 108 is passed through a pair of aligned holes 104 and 106 of the arcuate frame side members 100 and 102 at each side, such as to permit the modular unit 12 to be pivotally attached to the modular unit 14, and a second rod 110 is passed through opposite aligned holes 104 in the arcuate frame side members 100 and peripherally abuts on top of the arcuate frame side members 102. The choice of the pair of holes 104 used for passage of the rod 110 determines the amount of angular disposition of the back supporting area 26 of the chair relative to the seat supporting area 28 of the chair. The structure of the chair 10' illustrated at FIG. 22 is of simple construction, with the chordal load-supporting straps 22 of both modular units 10 and 14 attached directly to the cross-bar members 20 by being glued or stapled, for example, to the peripheral surface of each cross-bar member 20, the chordal straps 22 of one unit being spaced apart, as shown at 24, of the appropriate distance permitting the chordal straps 22 of one modular unit to interlace within the spaces 24 with the chordal straps of the other unit. Each end of the cross-bar members 20 is fitted to the arcuate frame side members 100 and 102, respectively, through an appropriate aperture 99 formed proximate each end of each arcuate frame side member 100 or 102, and is cemented therein, or brazed or welded, according to the type of material used for the manufacture of the chair 10'.

The structure of the chair 10' of FIG. 23 is not quite as simplified as the structure of FIG. 22, and includes the particular arrangement hereinbefore described for attaching and anchoring the ends of the chordal straps 22 to the cross-bar members 20, which consists in the mounting straps or loops 50 and the corresponding mounting rods, not shown. The chair 10'' is also provided with an appropriate headrest cushion pad 30 and a seat pad 32. The arcuate frame side support members 100 and 102 are made of laminated wood or laminated metal strips and are provided with a width progressively increasing from each end towards the center portion. The connecting and adjusting rods 108 and 110 are provided at their projecting ends with a protective cap 112 made of rubber or plastic or, alternatively, in the form of a metallic nut of attractive design threading on the projecting end of each of the rods 108 and 110 which are appropriately provided with a peripheral thread at their ends for that purpose.

Figure 24:
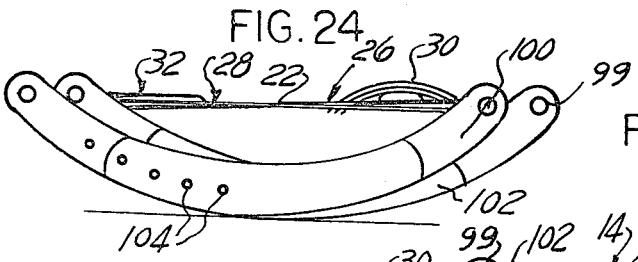
FIGS. 24–26 are schematic side elevation views illustrating diverse positions to which the chair of FIG. 23 can be adjusted.
Figure 25:
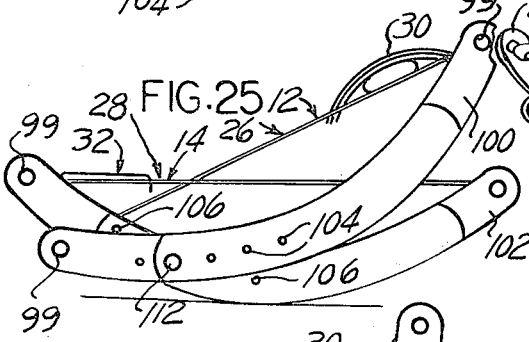
Figure 26:
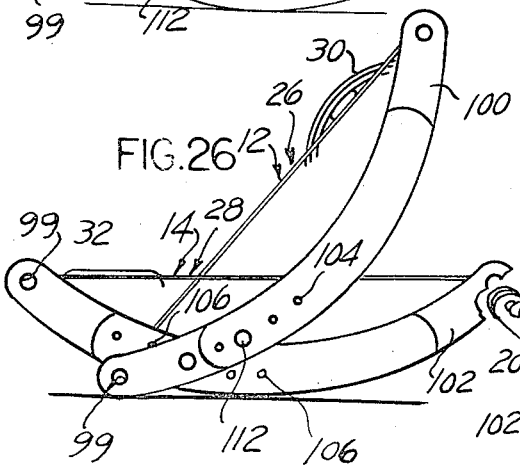

As schematically illustrated at FIG. 24, in order to form a rocking hammock-like structure, both rods 108 and 110 may be removed, and the modular units 12 and 14 disposed nested one within the other such that chordal straps 22 of both modular units are substantially co-planar and form a practically continuous body-supporting surface. By placing only the pivot rod 108 through the appropriate aligned double pairs of holes 104 and 106 in the walls of the arcuate support members 100 and 102, a structure as schematically illustrated at FIG. 25 is obtained, with the modular unit 12 capable of freely pivoting relative to the modular unit 14. Once the angular position determining rod 110 is passed through a pair of aligned opposite holes 104 through the arcuate support members 100 of the modular unit 12, the modular unit 12 is retained in an appropriate angular position depending on the location of the opposite holes 104 which are used, as illustrated schematically at FIG. 26. The angular relationship between the back support area 26 and the seat supporting area 24 is capable of appropriate adjustment by removing the rod 110 and passing it through different pairs of aligned opposite holes 104.

An alternate structure for disposing the modular unit 14 within the modular unit 12 at an angular relationship relative to each other consists in forming on the interior surface of the arcuate support member 100, as schematically illustrated at FIGS. 27–29, a series of spaced, downwardly oriented notches 105, and a series of regular spaced upwardly directed notches 107 and placing a rod 109 extending transversely from the left arcuate support member 100 to the corresponding right one in opposite aligned notches 105 and similarly disposing a rod 109 into opposite aligned notches 107. According to the position of the notches chosen for placing each of the rods 109 diverse angular positioning of one modular unit 12 relative to the other 14 can thus be accomplished.

The modular unit 12 and 14, after intermeshing and interlacing one within the other, may also be fastened together in a permanent manner. An example of such structure is illustrated at FIGS. 30 and 31 wherein the arcuate bowed support members 16 of each modular unit, which may consist of a pair or of a plurality of such members as in the structure of FIG. 1, are made of metal and are welded or brazed together at the area where they interlace, as shown at 111.

A further structure permitting semi-permanent and subsequently adjustable coupling between a modular unit 12 and a modular unit 14 results, for example and as illustrated schematically at FIGS. 32–34, from manufacturing both units with a frame structure of substantially the same width, inserting one unit within the other with the lateral bowed arcuate support members 16 of the modular unit 12, for example, placed immediately above the bowed arcuate support members **16*a* of the modular unit 14. The bowed arcuate support members 16 are provided with regularly spaced transverse bores 113 through which are passed bolts 114 threaded into aligned threaded bores 116 disposed in the bowed arcuate support members 16*a* such that, by removing the bolts and angularly disposing one modular unit relative to the other, diverse inclinations of the back area 26 relative to the seat area 28 may be obtained which are of a semi-permanent nature. Preferably, and as best illustrated at FIG. 34, the arcuate support members 16 have a central longitudinal groove 118 and the arcuate support members 16*a* have a corresponding centrally disposed dorsal ridge 120 projecting in the groove 118. It will be readily appreciated by those skilled in the art that means other than the bolt 114 may be used for clamping together the bowed arcuate support members 16 and 16*a*, such as brackets or appropriate pressure clamps or collars. Such a structure, as illustrated at FIGS. 32–33 permit to obtain rocking hammocks having a load carrying surface in the form of two areas disposed at an angle to each other. In addition, the bolts 114 may be omitted and the bowed arcuate support members 16 and 16*a*** permanently joined together by cementing, brazing or welding, according to the materials used, for forming non-adjustable structures.

Having thus described the present invention by way of structural examples of the best mode contemplated for practicing the invention, modifications whereof will be apparent to those skilled in the art, what is claimed as new is as follows:

1. A chair made of a pair of substantially identical modular units nested within each other, each of said modular units comprising at least a pair of rigid substantially parallel disposed bowed arcuate support members in the general form of a circular arc, a pair of substantially parallel cross-bar members each rigidly interconnecting said bowed arcuate members at each end, and a plurality of spaced apart substantially parallel strips of relatively thin pliable material defining chordal straps extending substantially along a chord of said circular arc formed by each of said bowed arcuate members and each attached at an end to one of said cross-bar members, the width of the space between adjacent chordal straps being uniform and substantially at least equal to the width of each of said chordal straps, wherein said modular units are disposed one within the other in such manner that the chordal straps of one modular unit are each disposed within a space between adjacent chordal straps of the other modular unit.

2. The chair of claim 1 wherein at least one of said modular units comprises a plurality of regularly spaced apart bowed arcuate members.

3. The chair of claim 1 wherein at least one of said modular units comprises a pair of said bowed arcuate support members, said cross-bar members extending transversely each from one end of one of said arcuate support members to the corresponding end of the other of said arcuate support members.

4. The chair of claim 1 wherein each of said modular units comprises a plurality of regularly spaced apart bowed arcuate members.

5. The chair of claim 1 wherein each of said modular units comprises a pair of said bowed arcuate support members, said cross-bar members extending transversely each from one end of one of said arcuate support members to the corresponding end of the other of said arcuate support members.

6. The chair of claim 1 wherein each of at least a pair of said bowed arcuate members of one of said modular units is superimposed over a corresponding bowed arcuate member of the other of said modular units.

7. The chair of claim 2 wherein each of at least a pair of said bowed arcuate members of one of said modular units is superimposed over a corresponding bowed arcuate member of the other of said modular units.

8. The chair of claim 3 wherein each of at least a pair of said bowed arcuate members of one of said modular units is superimposed over a corresponding bowed arcuate member of the other of said modular units.

9. The chair of claim 4 wherein each of at least a pair of said bowed arcuate members of one of said modular units is superimposed over a corresponding bowed arcuate member of the other of said modular units.

10. The chair of claim 5 wherein each of at least a pair of said bowed arcuate members of one of said modular units is superimposed over a corresponding bowed arcuate member of the other of said modular units.

11. The chair of claim 6 further comprising means for permanently joining said superimposed bowed arcuate members with the chordal straps of one of said modular units being disposed in a first plane at an angle with a second plane in which are disposed the chordal straps of the other of said modular units.

12. The chair of claim 7 further comprising means for permanently joining said superimposed bowed arcuate members with the chordal straps of one of said modular units being disposed in a first plane at an angle with a second plane in which are disposed the chordal straps of the other of said modular units.

13. The chair of claim 8 further comprising means for permanently joining said superimposed bowed arcuate members with the chordal straps of one of said modular units being disposed in a first plane at an angle with a second plane in which are disposed the chordal straps of the other of said modular units.

14. The chair of claim 9 further comprising means for permanently joining said superimposed bowed arcuate members with the chordal straps of one of said modular units being disposed in a first plane at an angle with a second plane in which are disposed the chordal straps of the other of said modular units.

15. The chair of claim 10 further comprising means for permanently joining said superimposed bowed arcuate members with the chordal straps of one of said modular units being disposed in a first plane at an angle with a second plane in which are disposed the chordal straps of the other of said modular units.

16. The chair of claim 7 further comprising means for removably and adjustably joining said superimposed bowed arcuate members such that the chordal straps of one of said modular units are disposed in a first plane at an adjustably variable angle with a second plane in which are disposed the chordal straps of the other of said modular units.

17. The chair of claim 8 further comprising means for removably and adjustably joining said superimposed bowed arcuate members such that the chordal straps of one of said modular units are disposed in a first plane at an adjustably variable angle with a second plane in which are disposed the chordal straps of the other of said modular units.

18. The chair of claim 9 further comprising means for removably and adjustably joining said superimposed bowed arcuate members such that the chordal straps of one of said modular units are disposed in a first plane at an adjustably variable angle with a second plane in which are disposed the chordal straps of the other of said modular units.

19. The chair of claim 10 further comprising means for removably and adjustably joining said superimposed bowed arcuate members such that the chordal straps of one of said modular units are disposed in a first plane at an adjustably variable angle with a second plane in which are disposed the chordal straps of the other of said modular units.

20. The chair of claim 1 wherein each of the bowed arcuate members of one of said modular units is disposed within each space between the bowed arcuate members of the other of said modular units.

21. The chair of claim 2 wherein each of the bowed arcuate members of one of said modular units is disposed within each space between the bowed arcuate members of the other of said modular units.

22. The chair of claim 3 wherein each of the bowed arcuate members of one of said modular units is disposed within each space between the bowed arcuate members of the other of said modular units.

23. The chair of claim 4 wherein each of the bowed arcuate members of one of said modular units is disposed within each space between the bowed arcuate members of the other of said modular units.

24. The chair of claim 5 wherein each of the bowed arcuate members of one of said modular units is disposed within each space between the bowed arcuate members of the other of said modular units.

25. The chair of claim 20 wherein each of the bowed arcuate members of one of said modular units is disposed substantially parallel to a corresponding bowed arcuate member of the other of said modular units.

26. The chair of claim 21 wherein each of the bowed arcuate members of one of said modular units is disposed substantially parallel to a corresponding bowed arcuate member of the other of said modular units.

27. The chair of claim 22 wherein each of the bowed arcuate members of one of said modular units is disposed substantially parallel to a corresponding bowed arcuate member of the other of said modular units.

28. The chair of claim 23 wherein each of the bowed arcuate members of one of said modular units is disposed substantially parallel to a corresponding bowed arcuate member of the other of said modular units.

29. The chair of claim 25 wherein the bowed arcuate members of one of said modular units are permanently joined to the corresponding bowed arcuate members of the other of said modular units.

30. The chair of claim 26 wherein the bowed arcuate members of one of said modular units are permanently joined to the corresponding bowed arcuate members of the other of said modular units.

31. The chair of claim 27 wherein the bowed arcuate members of one of said modular units are permanently joined to the corresponding bowed arcuate members of the other of said modular units.

32. The chair of claim 28 wherein the bowed arcuate members of one of said modular units are permanently joined to the corresponding bowed arcuate members of the other of said modular units.

33. The chair of claim 3 wherein one of said modular units is angularly adjustable relative to the other of said modular units.

34. The chair of claim 48 wherein one of said modular units is angularly adjustable relative to the other of said modular units.

35. The chair of claim 5 wherein one of said modular units is angularly adjustable relative to the other of said modular units.

36. The chair of claim 6 wherein one of said modular units is angularly adjustable relative to the other of said modular units.

37. The chair of claim 33 wherein the means for angularly adjusting one of said modular units relative to the other of said modular units comprises a pair of substantially parallel transverse rods one of which is disposed above the bowed arcuate members of one of said modular units and below the bowed arcuate members of the other of said modular units and the other of said rods is disposed below the bowed arcuate members of the first mentioned one of said modular units and above the bowed arcuate members of the second mentioned one of said modular units, and means interconnecting said transverse rods substantially parallel to each other at a predetermined distance from each other.

38. The chair of claim 34 wherein the means for angularly adjusting one of said modular units relative to the other of said modular units comprises a pair of substantially parallel transverse rods one of which is disposed above the bowed arcuate members of one of said modular units and below the bowed arcuate members of the other of said modular units and the other of said rods is disposed below the bowed arcuate members of the first mentioned one of said modular units and above the bowed arcuate members of the second mentioned one of said modular units, and means interconnecting said transverse rods substantially parallel to each other at a predetermined distance from each other.

39. The chair of claim 35 wherein the means for angularly adjusting one of said modular units relative to the other of said modular units comprises a pair of substantially parallel transverse rods one of which is disposed above the bowed arcuate members of one of said modular units and below the bowed arcuate members of the other of said modular units and the other of said rods is disposed below the bowed arcuate members of the first mentioned one of said modular units and above the bowed arcuate members of the second mentioned one of said modular units, and means interconnecting said transverse rods substantially parallel to each other at a predetermined distance from each other.

40. The chair of claim 36 wherein the means for angularly adjusting one of said modular units relative to the other of said modular units comprises a pair of substantially parallel transverse rods one of which is disposed above the bowed arcuate members of one of said modular units and below the bowed arcuate members of the other of said modular units and the other of said rods is disposed below the bowed arcuate members of the first mentioned one of said modular units and above the bowed arcuate members of the second mentioned one of said modular units, and means interconnecting said transverse rods substantially parallel to each other at a predetermined distance from each other.

41. The chair of claim 37 wherein said means for interconnecting said transverse rods is adjustable in length.

42. The chair of claim 38 wherein said means for interconnecting said transverse rods is adjustable in length.

43. The chair of claim 39 wherein said means for interconnecting said transverse rods is adjustable in length.

44. The chair of claim 40 wherein said means for interconnecting said transverse rods is adjustable in length.

45. The chair of claim 33 wherein the bowed arcuate members of one of said modular units are pivotally joined to the bowed arcuate members of the other modular unit by means of a transverse pivot member.

46. The chair of claim 34 wherein the bowed arcuate members of one of said modular units are pivotally joined to the bowed arcuate members of the other modular unit by means of a transverse pivot member.

47. The chair of claim 35 wherein the bowed arcuate members of one of said modular units are pivotally joined to the bowed arcuate members of the other modular unit by means of a transverse pilot member.

48. The chair of claim 36 wherein the bowed arcuate members of one of said modular units are pivotally joined to the bowed arcuate members of the other modular unit by means of a transverse pilot member.

49. The chair of claim 45 further comprising means for adjustably varying the angular position of one of said modular units relative to the other.

50. The chair of claim 46 further comprising means for adjustably varying the angular position of one of said modular units relative to the other.

51. The chair of claim 47 further comprising means for adjustably varying the angular position of one of said modular units relative to the other.

52. The chair of claim 33 wherein the means for angularly adjusting one of said modular units relative to the other comprises a plurality of regularly spaced upwardly directed notches in the bowed arcuate members of one of said units, a plurality of downwardly directed aligned notches in the bowed arcuate members of the other of said modular unit, and a pair of transversely disposed rods one of which has each end engaged in one of said vertically disposed notches and the other has each end engaged in one of said downwardly directed notches.

53. The chair of claim 34 wherein the means for angularly adjusting one of said modular units relative to the other comprises a plurality of regularly spaced upwardly directed notches in the bowed arcuate members of one of said units, a plurality of downwardly directed aligned notches in the bowed arcuate members of the other of said modular unit, and a pair of transversely disposed rods one of which has each end engaged in one of said vertically disposed notches and the other has each end engaged in one of said downwardly directed notches.

54. The chair of claim 35 wherein the means for angularly adjusting one of said modular units relative to the other comprises a plurality of regularly spaced upwardly directed notches in the bowed arcuate members of one of said units, a plurality of downwardly directed aligned notches in the bowed arcuate members of the other of said modular unit, and a pair of transversely disposed rods one of which has each end engaged in one of said vertically disposed notches and the other has each end engaged in one of said downwardly directed notches.

55. The chair of claim 36 wherein the means for angularly adjusting one of said modular units relative to the other comprises a plurality of regularly spaced upwardly directed notches in the bowed arcuate members of one of said units, a plurality of downwardly directed aligned notches in the bowed arcuate members of the other of said modular unit, and a pair of transversely disposed rods one of which has each end engaged in one of said vertically disposed notches and the other has each end engaged in one of said downwardly directed notches.

56. The chair of claim 1 wherein said chordal straps are adjustably attached to said cross-bar members.

* * * * *

UNITED STATES PATENT AND TRADEMARK OFFICE

CERTIFICATE OF CORRECTION

PATENT NO. : 4,278,288

DATED : July 14, 1981

INVENTOR(S) : Sacha Thebaud

It is certified that error appears in the above—identified patent and that said Letters Patent is hereby corrected as shown below:

Column 4, line 65, "12" should read -- 22 --.

Column 5, line 37, "12" should read -- 22 --.

line 67 "12" should read -- 22 --.

Column 6, line 2,"12" should read -- 22 --.

line 11, "strips 12" should read -- straps 22 --.

line 23 "strips 12" should read -- straps 22 --.

Column 7, line 22, "10' "should read -- 10" --.

Column 11, line 24, "48" should read -- 4 --.

Signed and Sealed this

*Sixteenth* Day of *February 1982*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,278,288

DATED : July 14, 1981

INVENTOR(S) : Sacha Thebaud

It is certified that error appears in the above-identified patent and that said Letters Patent is hereby corrected as shown below:

```
Column 4, line 53, change "12" to --22--.
          line 57, change "12" to --22--.
          line 67, change "12" to --22--.
Column 5, line 45, change "12" to --22--.
          line 49, change "12" to --22--and insert thereafter
                   --is passed around the--.
          line 50, change "12" to --22--.
          line 55, change "12" to --22--.
          line 59, change "12" to --22--.
          line 62, change "12" to --22--.
Column 6, line 5, change "12" to --22--.
          line 38, change "12" to --22--.
          line 39, change "12" to --22--.
```

Signed and Sealed this

*Twenty-fourth* Day of *August 1982*

[SEAL]

*Attest:*

GERALD J. MOSSINGHOFF

*Attesting Officer*

*Commissioner of Patents and Trademarks*